US006517674B1

(12) United States Patent
Das

(10) Patent No.: US 6,517,674 B1
(45) Date of Patent: Feb. 11, 2003

(54) PROCESS FOR MANUFACTURING WEAR RESISTANT PAPER

(75) Inventor: Amit Das, Pickerington, OH (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/570,088

(22) Filed: May 12, 2000

Related U.S. Application Data

(60) Provisional application No. 60/179,838, filed on Feb. 2, 2000.

(51) Int. Cl.[7] ..... D21H 27/10; D21H 23/04; D21H 19/00

(52) U.S. Cl. ..... 162/135; 162/158; 162/181.1; 162/164.1; 162/165; 162/183; 162/181.4; 427/391

(58) Field of Search ..... 162/181.1, 135, 162/181.2, 181.4, 177, 168.1, 169, 164.4, 183–185, 181.5–181.6, 158, 179, 164.1; 428/195, 203–204, 206, 323, 326, 329, 340–341, 207, 211, 402, 533–535, 537.5; 156/307.4, 83; 427/391, 420, 421

(56) References Cited

U.S. PATENT DOCUMENTS

| | | | | | |
|---|---|---|---|---|---|
| 3,786,041 | A | | 1/1974 | Talsma | 260/17.3 |
| 3,968,291 | A | | 7/1976 | Chevallier | 428/203 |
| 4,076,666 | A | | 2/1978 | Power et al. | 260/22 |
| 4,284,453 | A | | 8/1981 | Endrizzi | 156/154 |
| 4,311,489 | A | | 1/1982 | Kressner | |
| 4,322,468 | A | | 3/1982 | Raghava | 428/204 |
| 4,376,812 | A | | 3/1983 | West | 428/165 |
| 4,400,423 | A | | 8/1983 | Scher et al. | 428/204 |
| 4,430,375 | A | | 2/1984 | Scher et al. | 428/148 |
| 4,450,194 | A | | 5/1984 | Kauffman et al. | 428/172 |
| 4,530,856 | A | | 7/1985 | Kauffman et al. | 427/197 |
| 4,547,245 | A | | 10/1985 | Colyer | 156/220 |
| 4,713,138 | A | * | 12/1987 | Ungar et al. | 156/307.4 |
| 4,869,957 | A | | 9/1989 | Vankerckhoven et al. | 428/352 |
| 4,880,689 | A | | 11/1989 | Park et al. | 428/143 |
| 4,940,503 | A | * | 7/1990 | Lindgren et al. | 156/279 |
| 4,950,500 | A | | 8/1990 | Kauffman et al. | 427/197 |
| 4,971,855 | A | | 11/1990 | Lex et al. | 428/206 |
| 5,093,185 | A | * | 3/1992 | Ungar et al. | 428/204 |
| 5,141,799 | A | * | 8/1992 | Mehta et al. | 428/207 |
| 5,230,945 | A | | 7/1993 | Dees, Jr. et al. | 428/195 |
| 5,268,204 | A | | 12/1993 | Hill et al. | 427/393 |
| 5,288,540 | A | | 2/1994 | Albrinck et al. | 428/208 |
| 5,342,649 | A | | 8/1994 | Sarokin | |
| 5,344,704 | A | | 9/1994 | O'Dell et al. | 428/323 |
| 5,350,624 | A | | 9/1994 | Georger et al. | 428/219 |
| 5,362,557 | A | | 11/1994 | Albrinck et al. | 428/323 |
| 5,412,019 | A | * | 5/1995 | Roulstone et al. | 524/497 |
| 5,433,824 | A | | 7/1995 | Richardson | 162/8 |
| 5,466,511 | A | * | 11/1995 | O'Dell et al. | 428/207 |
| 5,478,640 | A | | 12/1995 | Berbner et al. | 428/283 |
| 5,545,476 | A | | 8/1996 | O'Dell et al. | 428/327 |
| 5,558,906 | A | | 9/1996 | Albrinck et al. | 427/180 |
| 5,573,827 | A | * | 11/1996 | Kubota et al. | 428/143 |
| 5,728,797 | A | | 3/1998 | O'Dell et al. | 528/120 |
| 5,807,608 | A | | 9/1998 | O'Dell et al. | 427/195 |
| 5,820,937 | A | * | 10/1998 | Crabtree et al. | 427/420 |
| 5,928,778 | A | | 7/1999 | Takahashi et al. | |
| 5,962,123 | A | * | 10/1999 | Mehta et al. | 428/326 |
| 5,962,134 | A | | 10/1999 | Shah et al. | 428/407 |
| 6,020,435 | A | | 2/2000 | Blankenship et al. | |
| 6,040,044 | A | | 3/2000 | Takahashi et al. | |
| 6,290,815 | B1 | * | 9/2001 | Magnin et al. | 162/181.1 |

FOREIGN PATENT DOCUMENTS

| | | | |
|---|---|---|---|
| GB | 1591954 | | 7/1981 |
| WO | 97/26410 | * | 7/1997 |
| WO | 9726410 | | 9/1997 |
| WO | WO 00/43132 | | 7/2000 |
| WO | WO 01/45940 A1 | | 6/2001 |
| WO | WO 01/92037 A2 | | 12/2001 |

* cited by examiner

*Primary Examiner*—Jose A. Fortuna
(74) *Attorney, Agent, or Firm*—Thompson Hine LLP

(57) ABSTRACT

Abrasion resistant papers such as overlays or decor sheets useful in decorative laminates, and in particular, to abrasion resistant papers incorporating spacer or separator particles to minimize the amount of damage to highly polished caul plates caused by contact of the caul plates with abrasion resistant materials during the lamination process and a process for manufacturing such abrasion resistant papers.

23 Claims, No Drawings

PROCESS FOR MANUFACTURING WEAR RESISTANT PAPER

This application claims priority from U.S. Provisional Application No. 60/179,838 filed Feb. 2, 2000.

FIELD OF THE INVENTION

The present invention relates to abrasion resistant papers such as overlays or decor sheets useful in decorative laminates, and in particular, to abrasion resistant papers incorporating spacer or separator particles to minimize the amount of damage to highly polished caul plates caused by contact of the caul plates with abrasion resistant materials during the lamination process. The invention also relates to a process for manufacturing such abrasion resistant papers.

BACKGROUND OF THE INVENTION

Decorative laminates are conventionally produced by stacking and curing under heat and pressure a plurality of layers of paper impregnated with a synthetic thermosetting resin. In normal practice the assembly from the bottom up, consists of three to eight core sheets made from phenolic resin impregnated kraft paper, above which lies a pattern or decor sheet impregnated with melamine resin; on top of the decor sheet is provided an overlay sheet which, in the laminate, is almost transparent and provides protection for the pattern sheet.

The overlay sheet is almost invariably used when the decor or pattern sheet has a surface printing in order to protect the printing from abrasive wear. The overlay sheet is usually a high quality alpha cellulose paper of about 20–30 pounds ream weight that is also impregnated with melamine-formaldehyde resin in a manner similar to that used for the decor sheet, except that a greater amount of resin per unit weight of paper is used. The individual sheets are stacked in the manner indicated above.

It is well known that the addition of small, hard abrasion resistant particles (also referred to as "grit") to the overlay paper, or to resin mixtures which coat the impregnated decor sheet, can enhance the abrasion resistance of high-pressure laminates. Alumina has been used to give wear resistance of 400 to 600 cycles. However, abrasion resistant particles tend to scratch and cause significant damage to highly polished caul plates used during the lamination process for producing both high pressure and low pressure laminates. Caul plates scratched or otherwise damaged through contact with abrasion resistant materials must either be resurfaced or replaced at a significant cost. The estimated cost to resurface the caul plate is currently approximately \$0.01 to 0.02/ft$^2$.

One of the conventional methods for producing abrasion resistant laminates without damaging the caul plates involves the use of release paper which provides a physical barrier separating the abrasive grit particles from the caul plates. The use of release paper is undesirable from a cost perspective. The release paper costs approximately \$0.02 to \$0.05/ft$^2$. Various attempts have been made to produce an abrasion resistant overlay or decor sheet which could be formed into a decorative laminate without damaging the expensive, highly polished caul plates and did not require the use of release paper. U.S. Pat. No. 4,971,855 to Lex, et al. discloses the use of extremely small (less than 9 microns) abrasion resistant particles in the production of a wear resistant, glossy laminate which does not result in rapid destruction of the caul plates during lamination. U.S. Pat. No. 5,545,476 to O'Dell, et al. discloses a wear and abrasion resistant glossy laminate having a thick protective coating incorporating pre-cured thermoset resin particles of up to 250 microns which protect the caul plates from the smaller abrasion resistant particles in the overlayer coating.

These previous methods for producing an abrasion resistant laminate without causing rapid destruction of the expensive caul plates are not without potential disadvantages. Small particle size grit, while preventing rapid destruction of the polished caul plates, still results in scratches on the caul plate surface where the grit contacts the caul plate. Furthermore, larger particle size grit is preferred as the larger particles, in general, provide better abrasion resistance. The effectiveness of pre-cured resin particles as spacers or separator particles can vary depending a number of variables, such as, the degree of cure, particle size distribution, particle shape and particle distribution within the resin matrix. Therefore, it would be desirable to be able to produce high and low pressure laminates exhibiting improved abrasion resistance associated with the use of larger size grit while providing protection for the expensive caul plates from the abrasive grit particles.

SUMMARY OF THE INVENTION

This invention relates to wear resistant papers and particularly to wear resistant papers which are useful in forming decorative laminates. The invention also relates to methods for manufacturing these wear resistant papers. In accordance with the invention, microspheres are incorporated into a wear resistant sheet to minimize caul plate damage associated with the use of abrasion resistant particles. Abrasion resistant particles or grit are added to the sheet to impart wear resistant properties to the paper. The microspheres preferably are larger than the abrasion resistant particles and therefore function as spacer or separator particles providing protection for the caul plates from the abrasion resistant particles in the wear resistant paper. It has been found that the larger microspheres prevent excessive contact between the abrasion resistant particles and the expensive caul plates during subsequent lamination operations using the wear resistant paper. Accordingly, the invention provides for a wear resistant laminate that does not adversely affect the life of the caul plates. A principal use of wear resistant paper made in accordance with the invention is in decorative laminates of the type used for flooring and similar products. The microspheres and abrasion resistant particles are both applied on the paper machine in a cost effective, continuous process.

In accordance with a preferred embodiment of the invention, glass microspheres are intermixed with the fiber as a part of the paper matrix and abrasion resistant grit particles are separately applied to the paper web during the continuous manufacture of wear resistant paper on a commercial scale. In one embodiment, the microspheres are added to the fiber, for example by feeding a slurry of the microspheres continuously to a pulp stream that feeds the primary head box, and the mixture of microspheres and fiber is formed into a sheet on the wet end of a paper machine. In a second embodiment, the microspheres are sprayed onto the web from a fluidized bed. In another embodiment, the microspheres are mixed with water and applied to a fibrous web on the wet end of a paper machine using a coater such as a curtain or slot coater. In still another embodiment, the microsphere slurry is mixed with fiber and applied to the paper machine from a primary or secondary head box.

The term "wet end" as used herein refers to any location on the paper machine in the paper manufacturing process prior to the dryer can and particularly includes the addition of microspheres to the pulp stream feeding the head box, to the pulp in the fan box, in the beaters, or in a storage chest, spraying microspheres onto the web at any location prior to the dryer can, addition of the microspheres to the white water and applying a mixture of the microspheres and fiber as a surface coating by means of a secondary headbox or a slot orifice coater such as a curtain coater prior to the dryer can, e.g., between the dandy roll and the wet press, as well as a combination of these points prior to the dryer can, for example addition at the beaters and by application from a spray unit.

The term "slot coater or orifice slot coater" as used herein includes coaters in which the coating passes through an orifice and forms a curtain which falls on the web and coaters in which the coating is extruded through a slot where it forms a bead which contacts the web.

DETAILED DESCRIPTION

The microspheres useful in the present invention can be glass, ceramic or polymeric. The microspheres preferably are glass and most preferably soda lime glass. The soda lime glass fluoresces and thereby facilitates monitoring the distribution of the microspheres in the sheet. To function properly as spacer or separator particles, the particle size of the microspheres should be equal to or greater than the particle size of the abrasion resistant grit. Preferably, the microspheres are 2 to 10 times and most preferably 5 times the size of the abrasion resistant particles. Preferably, the microspheres have a diameter of between 35 and 200 microns while the abrasion resistant grit particles have a diameter of between 10 and 100 microns. The size of the microspheres is important in that the microspheres must be large enough to be retained on the sheet, but not so large as to interfere with functionality of the abrasion resistant particles or negatively impact clarity. A soda lime glass microsphere preferably having a diameter of about 85 to 100 microns is often useful. Likewise, the concentration of microspheres in the sheet is dictated by performance criteria. The microspheres must be present in an amount sufficient to effectively reduce caul plate damage while maintaining desired levels of clarity and abrasion resistance.

In accordance with the invention, microspheres and abrasion resistant particles are incorporated into a wear resistant sheet during the paper making process. The wear resistant sheet may be an overlay sheet or a decor sheet. The sheet is formed from fibers conventionally used for such purpose and, preferably, is formed from bleached kraft pulp. The pulp may consist of hardwoods or softwoods or a mixture of hardwoods and softwoods which is normally preferred. Higher alpha cellulose such as cotton may be added to enhance certain characteristics such as post-formability. The basis weight (including grit and microspheres) of the sheet may range from about 5 to 70 pounds per 3000 square feet, and is preferably about 15 to 50 pounds per 3000 square feet for an overlay. The glass microspheres can either be incorporated with the fibers in the stock chest or applied at various locations at the wet end of the paper machine. When intermixed with the fiber, the microspheres are present at between about 2 and 20 wt % of the fiber, and preferably about 10%. When applied to the forming sheet as a coating, the microspheres are applied to the sheet at a coat weight of about 2 to 10 pounds per 3000 square feet. By comparison, the grit typically is applied to the sheet at a coat weight of about 2 to 40 pounds per 3000 square feet (dry basis).

In accordance with the invention, the microspheres are added to the fiber at the wet end of the paper machine. This addition can be accomplished in several different operations. In accordance with one embodiment of the invention, the microspheres are mixed with the fiber before the fiber is deposited onto the wire. This process can be accomplished in the beaters, in a storage chest or fan pump, or microspheres can be continuously added to a pulp stream which feeds the headbox. The microspheres can also be applied to the wet fibrous mat from a spray unit. In other embodiments of the invention, a slurry of microspheres can be applied to the surface of the wet paper mat on the wire using a secondary headbox or using a slot coater and more particularly a curtain slot coater which is preferably situated on the paper machine before the wet press. Each of these embodiments of the invention is discussed below in more detail.

The microspheres can be mixed with the fiber to provide a furnish composition which is applied to the paper machine wire from the primary head box. The microspheres may be added to the furnish at any point in the formation or dilution of the fiber. For example, a slurry of microspheres can be added to the white water and used to dilute the pulp in any of the stock chests (e.g., the thick stock chest, the thin stock chest, or the machine chest), or the slurry can be added to the pulp in the beater or fan pump. When mixing the slurry with the pulp for application to the paper machine wire, the microsphere slurry typically contains about 1 to 5% solids. The slurry fed to the head box as part of the furnish contains about 0.5 to 0.7% solids.

Microspheres can also be applied to the wet end of a paper machine by spraying. The microspheres are preferably sprayed at a velocity sufficient to cause at least partial embedment in the wet fibrous mat. The spray coating unit can be located anywhere on the wet end of the paper machine, but the microspheres are preferably applied on the wire side during formation. The microspheres may optionally be spray coated with a thermosetting laminating resin or other resin or agent to hold the microspheres on the sheet. The thermosetting laminating resin preferably is a melamine formaldehyde resin although other resins such as polyesters, urea-formaldehyde, dicyandiamide-formaldehyde, epoxy, polyurethane, acrylics or mixtures thereof may also be used. The microspheres may be coated in the fluidized bed or by passing the spray of microspheres through a resin mist. The microspheres are preferably coated by spraying a solution or dispersion of resin in water to create a resin mist and spraying the microspheres through the resin mist to at least partially coat the microspheres. The resin particles in the mist are approximately 0.5 to 5 microns in size. Movement of the microspheres through the fine mist also induces an electrical charge to the microspheres. The resin coating and electrical charge enhance anchorability of the microspheres to the paper web.

The resin solution or dispersion is prepared by dissolving or dispersing the resin in a solvent or water at a concentration of about 30 to 60%. The resin solution or dispersion is supplied to the resin spray unit and sprayed through a plurality of nozzles to produce a fine mist having an average particle size of between about 0.5 and 5 microns. The resin spray is directed so as to produce a mist positioned between the paper machine and the spray unit in fluid communication with the fluidized bed of microspheres. As the microspheres are sprayed in the direction of the web, they pass through the resin mist. The movement of the microspheres through the resin mist produces coated and charged microspheres which become firmly anchored to the paper web.

In applying the microspheres to the surface of the paper using a curtain slot coater, the microsphere slurry contains about 5 to 60% solids and is applied in an amount of about 1 to 20 lbs. microspheres per 3000 sq. ft. The curtain coating and wet press parameters and operating conditions are adjusted in a conventional manner to maximize retention. The preferred location for the slot curtain coater die is on the wet end of the paper machine just past the dandy roll. Other locations may be before the dandy, between the last vacuum box and wet press or anywhere between the dandy and the last vacuum box on the paper machine. The microspheres may be applied separately or in combination with the grit when using a slot coater. Some fiber may also be included.

In another embodiment of the invention, the slurry of the microspheres is applied from the secondary head box. For application from a secondary head box the slurry preferably contains 0.5 to 7% solids and more typically about 1 to 3% solids. The secondary headbox is located between the primary headbox and the dandy roll. When applying the slurry as a coating from a curtain coater or a secondary head box, it is important to avoid sealing the sheet so as to unacceptably impede resin impregnation. Again the microspheres can be applied alone or in combination with the grit and/or fiber when applied from a secondary headbox.

Typically, the grit is added in a separate step, but any known process for adding the grit or coating the paper can be employed to add the grit particles to the paper. The grit employed in the present invention can be a mineral particle such as silica, alumina, Alundum, corundum, emery, spinel, as well as other materials such as tungsten carbide, zirconium boride, titanium nitride, tantalum carbide, beryllium carbide, silicon carbide, aluminum boride, boron carbide, diamond dust; or a nonmineral particle such as clay, and mixtures thereof. The suitability of the particular grit will depend on several factors such as availability, cost, particle size availability and even the color of the particles. Considering cost availability, hardness, particle size availability and lack of color, aluminum oxide is the preferred grit for most applications. End use performance dictates the basis weight, ash loading, size and type of grit particles. Particularly useful in the present invention are 150, 180, 220, and 240 grade aluminum oxide grits.

When the microspheres are incorporated into the fiber or applied separately, the grit typically is prepared in the form of a slurry for applying to the web. The grit-containing slurry is applied to the raw fibrous cellulosic web using the secondary headbox or slot coater which distributes the grit-containing slurry evenly across the surface of the web. Currently a layer of grit and paper fibers is applied to the surface of the overlay sheet using a secondary headbox application on the papermaking machine. However, for improved distribution and coverage of grit across the web as well as improved distribution of grit in the Z direction of the sheet, it may be desirable to apply the grit using a slot coater such as a curtain coater.

The application of the grit may be positioned anywhere from the primary head box and before the dryers, but it is preferably located near and, more preferably, immediately after the dry line, i.e., the point at which the deposited fibers begin to exhibit consolidation and there is no layer of surface water. Typically the slurry contains about 0.5 to 2% by weight grit when applied from a secondary headbox and 1 to 40% by weight when applied using a slot coater.

The coating operations described herein are conducted at conventional web speeds which can range from 400 to 2000 feet per minute.

The use of a slot coater, and more particularly a curtain coater (as contrasted with a secondary head box) to apply the grit, can increase the efficiency of the grit application and reduces waste. The slot coating head applicator is used in conjunction with a positive displacement pump which enables a predetermined amount of the grit composition to be evenly distributed across the surface of the cellulosic sheet. A static mixer is preferably incorporated in the slot coater supply line to prevent or reduce the amount of grit settling out of the slurry.

A particular advantage of using a slot coating head applicator is that it enables the delivery of a predetermined amount of the slurry mixture to be applied in an evenly distributed manner to the surface of the overlay sheet. The use of the slot coating head applicator not only increases the efficiency of the operation by evenly distributing the grit slurry mixture across the decor sheet but it reduces the cost of the process significantly by reducing waste while still achieving required or desirable product standards. The use of the slot coating head applicator also enables the introduction of other materials and additives which are typically employed in such overlays to be incorporated directly into the grit slurry. For example, the incorporation of melamine resin in the grit mixture is possible and would allow the application of both resin and grit to the fibrous cellulosic sheet in a single step.

The slot coater can be used to apply slurries containing at least 5% and, more particularly, at least 10% solids. By comparison, a secondary headbox is generally used in applying slurries containing up to about 2% or 3% solids. As a result of the higher slurry concentrations that can be applied using a slot coater, higher line speeds and/or lower coating flow rates can be used than are feasible with application of the slurry from a secondary headbox. Using the headbox, it is not unusual when coating a web 10 feet wide to apply the coating at a flow rate of 500–1000 gallons per minute. At these rates, water from the coating slurry cascades through the sheet and carries significant quantities of unretained grit with it. With the slot coater, flow rates on the order of 5–10 gallons per minute are commonly used when coating a web 10 feet wide and the quantities of water and unretained grit are substantially less.

When the grit slurry is applied to the web using a slot coater, it is advantageous to include a thickener in the slurry. Thickeners are particularly recommended when the grit is applied using a slot coater such as a curtain coater. The thickener may be any of the commonly used binders such as melamine resins, polyvinyl alcohol, acrylic latex, starch, casein, styrene-butadiene latex, carboxymethyl cellulose (CMC), microcrystalline cellulose, sodium alginate, etc., or mixtures thereof which are used in coating compositions where the coating material is to be bonded to a substrate such as a decor sheet or overlay sheet. Melamine resins such as melamine-formaldehyde are advantageously used as the thickener material because the melamine-formaldehyde resin is also commonly used to saturate the decor sheet. The thickener is usually employed in an amount of about 1 to 10% by weight of coating solids.

A slot coater particularly useful in the present invention is a curtain coater sold by Liberty Tool Corp. under the tradename Technikote. When using a curtain coater, the slurry can be pumped to a Liberty Tool slot coating head under a pressure of 20 psi and applied to a layer of pulp one foot wide which had been deposited on the paper machine wire. The slurry can be dispensed from the coating head at a flow rate of 0.73 gallons per minute and a line speed of 67.5 lineal feet per min. The coating can be applied in a dry coat weight of about 10 pounds per 3000 sq.ft.

In a preferred embodiment of the invention, the microspheres are applied to the wire side of the web and the abrasion resistant particles are applied to the felt side of the web. In the typical laminating operation the wire side of the wear resistant paper comes in contact with the caul plates. Therefore, positioning the microspheres on the wire side and the abrasion resistant particles on the felt side tends to maximize the degree of protection for the caul plates while still providing a laminate having excellent wear and abrasion resistance.

Having described the invention in detail, it will be apparent that modifications and variations are possible without departing from the scope of the invention defined in the appended claims:

What is claimed is:

1. A process for producing a wear resistant paper for use in forming a decorative laminate which comprises the steps of:

forming a web of cellulose fibers and microspheres;

preparing a slurry of abrasion resistant particles; and applying said slurry of abrasion resistant particles to said web, wherein the particle size of said microspheres is at least 1.5 times the particle size of said abrasion resistant particles.

2. The process of claim 1 wherein said microspheres are ceramic, glass or polymeric.

3. The process of claim 2 wherein said microspheres are coated with a resin.

4. The process of claim 3 wherein said resin is selected from the group consisting of melamine formaldehyde resins and polyester resins.

5. The process of claim 2 wherein said microspheres have a particle size of about 35 to 200 microns.

6. The process of claim 2 wherein said microspheres are polymeric.

7. The process of claim 1 wherein said step of forming a web comprises forming a mat of cellulose fibers and spray coating said microspheres onto said mat at a velocity sufficient to cause at least partial embedment of the microspheres in the fibrous mat.

8. The process of claim 1 wherein said step of forming a web includes adding microspheres to fiber in a beater or storage chest or as the fiber is fed to a head box and depositing the fiber containing the microspheres on a paper-machine wire.

9. The process of claim 1 wherein said web has a basis weight of about 5 to 70 pounds per 3000 sq.ft.

10. The process of claim 9 wherein the wear resistant paper is an overlay paper.

11. The process of claim 9 wherein the wear resistant paper is a decor sheet.

12. The process of claim 1 wherein said microspheres are glass and have a particle size of about 85 to 100 microns.

13. The process of claim 1 wherein said microspheres are from 2–10 times the size of the abrasion resistant particles.

14. A process for producing a wear resistant paper for use in forming a decorative laminate which comprises the steps of:

coating microspheres with a thermosetting laminating resin to obtain at least partially coated microspheres;

forming a web on a paper machine from the coated microspheres and paper fibers;

preparing a slurry of abrasion resistant particles; and applying said slurry of abrasion resistant particles to said web on said paper machine, wherein the particle size of said microspheres is at least 1.5 times the particle size of said abrasion resistant particles.

15. The process of claim 14 wherein said step of coating said microspheres with a thermosetting laminating resin comprises the steps of:

providing a fluidized bed of microspheres;

spraying thermosetting laminating resin to form a resin mist; and contacting said microspheres with the resin mist.

16. The process of claim 15 wherein said resin mist comprises resin particles having a particle size of about 0.5 to 5 microns.

17. The process of claim 14 wherein said microspheres have a particle size of about 35 to 200 microns.

18. The process of claim 14 wherein said step of forming the web is performed by spraying the coated microspheres onto a mat of paper fibers on a paper machine.

19. The process of claim 14 wherein said web has a basis weight of about 5 to 70 pounds per 3000 sq.ft.

20. The process of claim 19 wherein said web is an overlay paper.

21. The process of claim 19 wherein said web is a decor sheet.

22. The process of claim 14 wherein said abrasion resistant particles are aluminum oxide.

23. The process of claim 14 wherein the particle size of said microspheres is at least 1.5 times the particle size of said abrasion resistant particles.

* * * * *